US009382714B2

(12) United States Patent
Richardson

(10) Patent No.: US 9,382,714 B2
(45) Date of Patent: Jul. 5, 2016

(54) TRUSS SYSTEM WITH INTEGRAL CHANNELS

(71) Applicant: Imagine TF, LLC, Los Gatos, CA (US)

(72) Inventor: Brian Edward Richardson, Los Gatos, CA (US)

(73) Assignee: Imagine TF, LLC, Los Gatos, CA (US)

( * ) Notice: Subject to any disclaimer, the term of this patent is extended or adjusted under 35 U.S.C. 154(b) by 0 days.

(21) Appl. No.: 14/349,191

(22) PCT Filed: Oct. 10, 2012

(86) PCT No.: PCT/US2012/059588
§ 371 (c)(1),
(2) Date: Apr. 2, 2014

(87) PCT Pub. No.: WO2013/055814
PCT Pub. Date: Apr. 18, 2013

(65) Prior Publication Data

US 2014/0250820 A1 Sep. 11, 2014

Related U.S. Application Data

(60) Provisional application No. 61/627,596, filed on Oct. 14, 2011.

(51) Int. Cl.

| | |
|---|---|
| ***E04B 1/18*** | (2006.01) |
| ***E04C 3/02*** | (2006.01) |
| ***E04C 3/08*** | (2006.01) |
| *E04C 3/04* | (2006.01) |
| *F21W 131/406* | (2006.01) |

(52) U.S. Cl.
CPC ... *E04C 3/02* (2013.01); *E04C 3/08* (2013.01); *E04C 2003/0491* (2013.01); *F21W 2131/406* (2013.01)

(58) Field of Classification Search
CPC ..... E04C 3/02; E04C 3/08; E04C 2003/0491; F21W 2131/406
USPC ..... 52/634, 636, 638
See application file for complete search history.

(56) References Cited

U.S. PATENT DOCUMENTS

| | | | | |
|---|---|---|---|---|
| 722,635 | A | 3/1903 | Schneider | |
| 1,174,501 | A * | 3/1916 | McCarty | 52/651.03 |
| 1,939,598 | A * | 12/1933 | Ragsdale | 52/650.1 |
| 2,308,565 | A | 1/1943 | Mitchell | |
| 2,345,650 | A | 4/1944 | Attwood | |
| 2,936,051 | A | 5/1960 | Martin | |
| 3,051,772 | A | 8/1962 | Davis | |
| 3,829,999 | A * | 8/1974 | Bernstein | 40/605 |
| 4,512,117 | A | 4/1985 | Lange | |
| 4,516,375 | A * | 5/1985 | Pagano et al. | 52/581 |
| 4,837,665 | A | 6/1989 | Hoyer et al. | |
| 4,862,336 | A | 8/1989 | Richardson et al. | |
| 5,119,613 | A * | 6/1992 | Atkinson et al. | 52/646 |

(Continued)

*Primary Examiner* — Basil Katcheves
(74) *Attorney, Agent, or Firm* — Venable LLP; Steven J. Schwarz

(57) ABSTRACT

A truss system designed to simplify the addition of lights, audio equipment, and other stage-related equipment through the use of essentially circular strut channel members. The system is designed to enclose such equipment, be lightweight, and facilitate easy set-up and take-down of truss assemblies. The lightweight truss system includes an open-sided structure with rigid ends, and a strut channel system that facilitates the installation of lights, audio equipment, and other stage-related devices.

12 Claims, 13 Drawing Sheets

(56) References Cited

U.S. PATENT DOCUMENTS

| | | | |
|---|---|---|---|
| 5,278,742 | A | 1/1994 | Garrett |
| 5,299,112 | A | 3/1994 | Nivette, Jr. et al. |
| 5,412,552 | A | 5/1995 | Fernandes |
| 5,551,199 | A | 9/1996 | Hayes et al. |
| 7,883,247 | B2 | 2/2011 | Calleja |
| 2004/0187426 | A1 | 9/2004 | Callahan |

* cited by examiner

TRUSS SYSTEM WITH INTEGRAL CHANNELS

CLAIM OF PRIORITY

This application is based on and claims priority to the U.S. Provisional Application Patent Application Ser. No. 61/627,596, filed on Oct. 14, 2011, which is expressly incorporated herein by reference.

BACKGROUND

The present system relates to truss systems where it is required that equipment or devices be mounted within the truss structure. Mounting equipment or devices within a truss section often are required for mobile entertainment systems. By mounting the equipment or devices within the truss section they can remain within the truss while the truss is being transported from venue to venue. Further it allows the truss section to be assembled at a remote location and then be transported to a venue. Devices typically mounted within a truss include sound or lighting equipment. The equipment mounted within a truss may also include chain motors to raise and lower other trusses below, scenery, and props.

Some systems of this type are available today for large-sized truss sections. Two such systems are disclosed in U.S. Pat. No. 4,862,336 to Richardson et al., and another U.S. Pat. No. 5,278,742 to Garrett. These systems have complex components beyond the truss structure to mount additional equipment. U.S. Pat. No. 5,743,060 to Hayes et al., describes a truss assembly that is also complex but is easy to assemble and lightweight. None of these prior art systems allow for equipment to be mounted within smaller truss sections. The larger truss sections in the prior art require special bracketing or mounting features above and beyond the structures that bear the truss loads. None of them, however, describe a light duty truss utilizing unistrut-like members that facilitate the mounting of lights and other components.

SUMMARY

An improved light-duty stage truss system. This truss utilizes strut channel members, which members readily accept numerous commercially available lighting and other attachments that are designed for attachment to such strut channel members. This feature saves time and money for the user, as compared to other truss systems.

The present truss system includes a plurality of elongate strut channel members positioned along a channel member axis. These strut channel members are disposed between two end plates, which may be shaped in any desired polygonal shape. The elongate strut channel member includes two side segments extending radially along respective intersecting side segment axes. Each side segment has a proximal corner end at which the two segments are attached, and a distal side segment end.

The strut channel member further includes a first curved segment, integral at a first curved segment proximal end with the side segment distal end of one of the side segments, and which first curved segment curves inward at a first curved segment distal end. There is a second curved segment, integral at a second curved segment proximal end with the side segment distal end of the other of the side segment, and which second curved segment curves inward at a second curved segment distal end. An important aspect of the present truss system is that the first curved segment distal end of the strut channel member is spaced apart from the second curved segment distal end to form a gap region therebetween.

In a preferred embodiment, at least one curved segment distal end includes a terminal inwardly-angled segment. This terminal inwardly-angled segment is used to secure an attachment device, such as a screw, bolt/nut assembly, spring nut, or others known and used in the art.

In an embodiment, at least one of the side segments includes a step segment. The step segment includes a length portion, extending inward along a short axis, which axis transects the side segment axis, and transecting the short axis at about a 90 degree angle. The step segment further includes a width portion having a length terminal end and a distal curved segment terminal end.

One embodiment of the present system includes a plurality of rigid structural flanges extending inward along the channel member axis at about a 90 degree angle from each side plate. The flanges include opposed terminal ends, wherein each flange terminal end is attached to one side segment of two strut channel members.

Another embodiment of the present system includes a plurality of rigid cross brace members having opposing ends. Each cross brace member is attached at each end to at least one side segment of two strut channel members. Further, each cross brace member is positioned between the two strut channel members at an acute angle thereto. In yet another embodiment, the present system includes reinforcement plates attached to the side plates and positioned adjacent each strut channel member extending from that side plate.

Also described herein is a new truss assembly, comprising a plurality of truss systems of the type described above.

There are several advantages of the present system. One advantage of the present system is the limited number of components and relatively simple construction. Another advantage of the present system is that by locating the fastening point of the equipment integral with structural members, more room is available for the equipment. In the case of lighting equipment, this aspect allows for more area for the light to exit the truss structure without being obstructed by the truss components.

A still further advantage is that, due to the nature of the system, the components, including the strut channel members, may be manufactured from aluminum, thus reducing the overall weight of the truss system. The present truss system also allows for fastening light fixtures and other equipment inside the truss. This results in reduced setup and strike time for users of the system.

These and other objects and advantages of the present system will become apparent to those skilled in the art in view of the description of the best presently known mode of carrying out the invention as described herein and as illustrated in the drawings.

DRAWINGS

DETAILED DESCRIPTION

Figure 1:
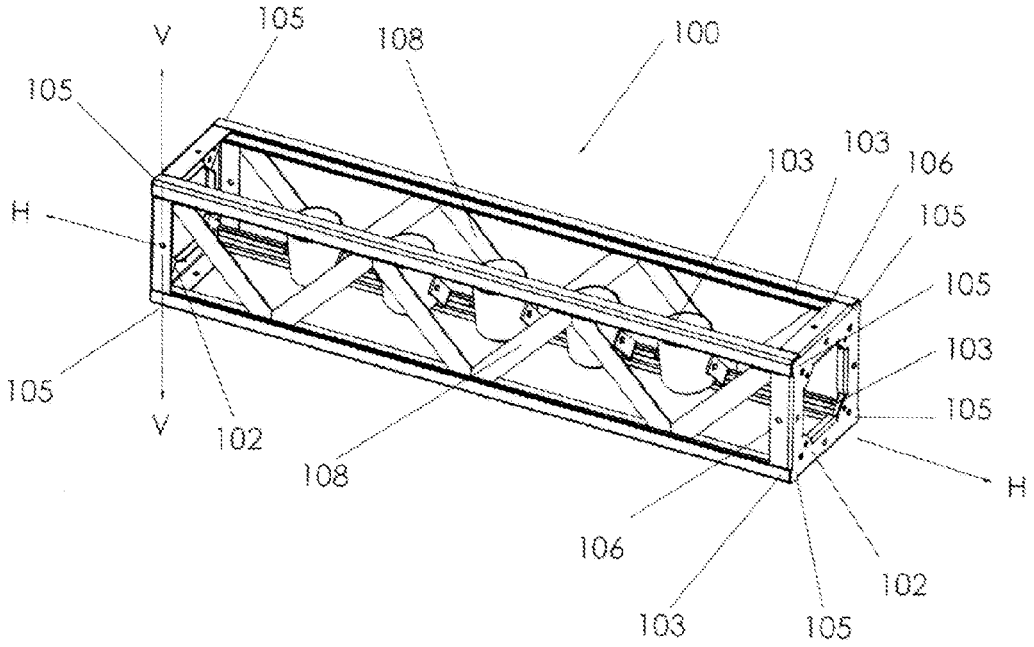
FIG. 1 is an isometric view of the present truss system, including installed lights components.

Referring first to FIG. 1, an embodiment of the present truss system 100 is shown. The truss system 100 includes two opposing end plates 102, and a plurality of strut channel members 103 connected to and extending between the two end plates 102, all along a horizontal axis H. The system 100 further includes a plurality of cross brace members 108 extending along and between parallel strut channel members 103 to provide structural support to the system 100.

In the illustrated embodiment of FIG. 1, the end plates 102 are configured in a square shape. The square shape optimizes the ability to stack, store, and transport the system 100. In alternative embodiments, the end plates 102 are oval, round, triangular, or polygonal, depending on the intended use of the system 100.

Connected to each end plate 102 are a plurality of elongate strut channel members 103. The end plates 102 have structural flanges 106 that extend between the strut channel members 103. These structural flanges 106 increase the stiffness of the end plate 102, and provide rigidity to the truss system 100. The structural flanges 106 are fastened to the interior portion of the truss members 103, as described in further detail below.

The truss system 100 is further strengthened structurally by a plurality of cross brace members 108. The cross brace members 108 are connected between two strut channel members 103 that are positioned opposite each other along a vertical axis V that transects the horizontal axis H. The cross brace members 108 are secured to each strut channel member 103 at generally a 45 degree angle.

Figure 1A:
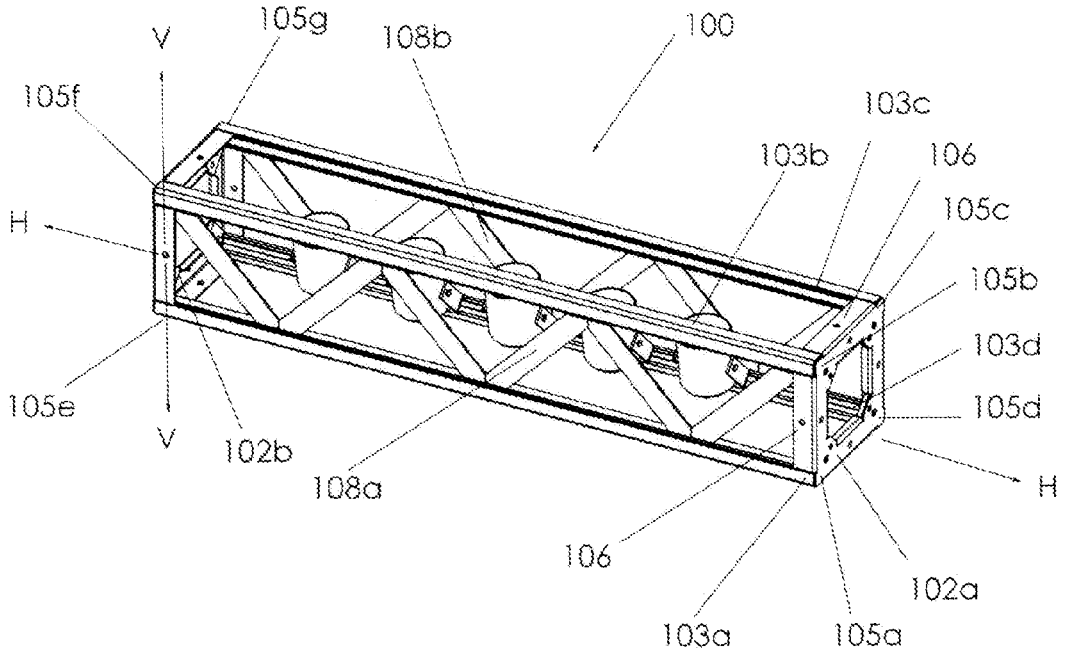
FIG. 1A is another isometric view of the present truss system.

As shown in further detail in FIG. 1A, the strut channel members 103*a*, 103*b*, 103*c* are fastened to end plate 102*a* at selective end plate corners 105*a*, 105*b*, 105*c*, 105*d*, respectively. In a preferred embodiment, each strut channel member 103 is attached to opposing corners 105 of the two end plates 102 along horizontal axis H. The strut channel members 103 are fastened to the corners 105 using methods known and used by those in the relevant art. Preferably the fastening is welding. Alternate methods of joining could be used, such as bolts or screws.

In a similar manner, the strut channel members 103*a*, 103*b*, 103*c*, 103*d* are fastened to the opposing end plate corners 105*e*, 105*f*, 105*g*, 105*h* (not shown) of the end plate 102*b*. All of the strut channel members 103 are parallel to one another when assembled. The length of the strut channel members 103 will vary for different applications. Short strut channel members 103 may be only a few feet in length, whereas long members 103 may be as long as about 10 feet. In a preferred embodiment, square-shaped end plates 102 are about 1-2 feet in length per truss system 100. These dimensions are typical of trusses in use today. The specific length of strut channel members 103 is a function of the application of the truss system 100 in which the strut channel members are used. Examples of various assemblies of the present truss system are disclosed and discussed in further detail below.

In the illustrated embodiment of FIG. 1A, and by way of example, cross brace member 108*a* is connected to strut channel members 103*a* and 103*b* at an approximately 45 degree angle. The illustrated configuration of cross members 108 is ideal for creating a structural truss system. As with the end plate 102 fastening to the truss member 103, the preferred fastening method is welding. Preferably the entire length of the structural members 103 is populated with cross brace members 108. Half of the cross brace members 108 are shown as orthogonal to the other half of the cross brace members 108. An alternate configuration orients all of the cross brace members 108 in the same orientation.

Figure 2:
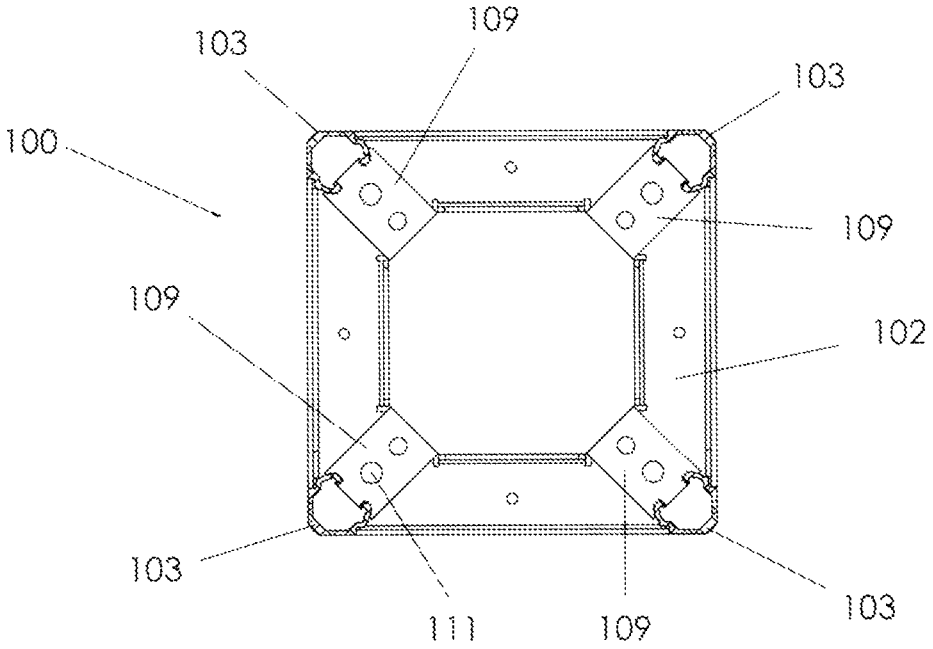
FIG. 2 is a cross-section view of the truss system of FIG. 1.

FIG. 2 shows a cross-section of the strut channel member 103. In a preferred embodiment, all of the strut channel members 103 have a similar cross-section. The strut channel members 103 preferably are arranged in a radial manner along the horizontal axis H extending from the center of the truss system 100. As shown, a reinforcement plate 109 preferably is included to increase the structural connection of the truss member 103 to the end plate 102. A plurality of reinforcement plates 109 are secured to the inboard surface of the end plates and are fastened to both the end plates 102 and the corresponding strut channel members 103. In a preferred embodiment, the reinforcement plates 109 are attached by welding.

In an embodiment, the reinforcement plate 109 includes a plurality of reinforcement mounting holes 111 to enable a plurality of truss systems 100 to be fastened together end to end. These holes 111 extend though the end plate 102. In a preferred embodiment, each strut channel member 103 includes a complementary reinforcement plate 109. The reinforcement plates 109 extend radially from the outer corner of the end plate 102 inward toward the center of the truss system 100.

Figure 3:
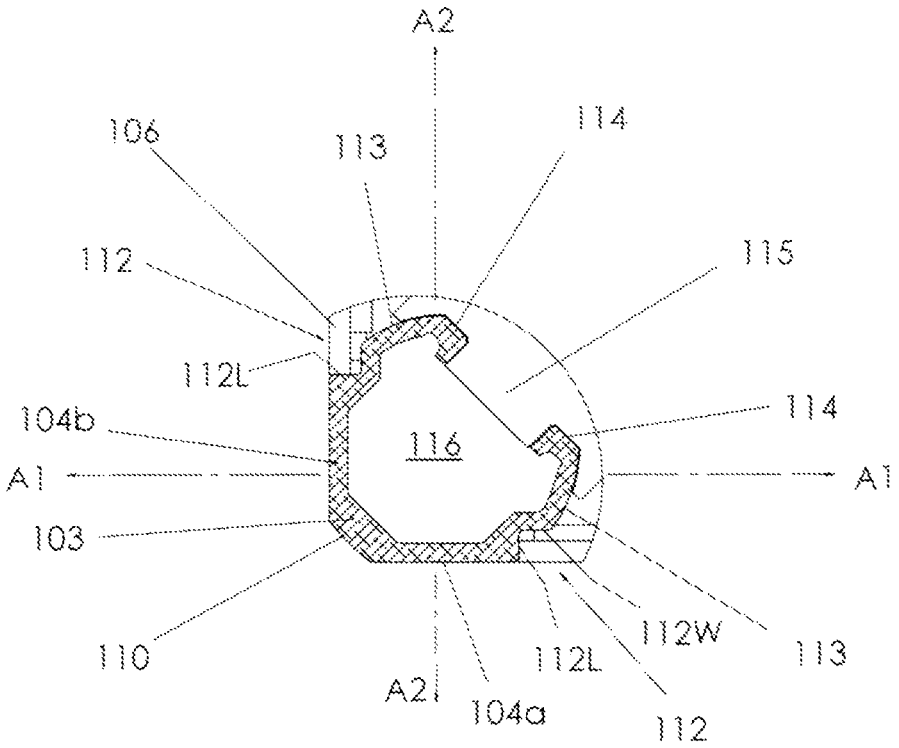
FIG. 3 is a cross-section view of a strut channel member of the present system.

Referring to FIG. 3, the cross-section of the strut channel member 103 is shown in further detail. Strut channel member 103 includes a corner segment 110 having two side segments 104*a*, 104*b* extending radially outward from the segment along a first axis A1 and a second axis A2, respectively, and which are coplanar with the structural flanges 106 of the end plate 102. In the illustrated embodiment, the side segments 104 are flat, to facilitate stacking and storing the systems. This coplanar arrangement allows for an essentially flat surface for the side, top and bottom of the truss system 100. In alternative embodiments, the side segments are curved. The side segments 104*a*, 104*b* are filleted by the corner segment 110.

Extending outward from the terminal end of each side segment 104*a*, 104*b* is an inverted L-shaped step segment 112, having a length 112L extending inward at essentially 90 degrees from the side segment axis and width 112W extending outward at essentially 90 degrees from length 112L, and along the axis of length 112L. In the illustrated embodiment, side segment 104*a* extends along axis A1, and the step segment length 112L extends at 90 degrees inward therefrom, along axis A2, while the step segment width 112W then extends 90 degrees outward therefrom and along axis A1. A complementary configuration exists for the opposing side segment 104*b*. The length 112L is at least the width of the associated structural flange 106 which is positioned adjacent the step segment 112.

In the illustrated embodiment of FIG. 3, curved segment 113 of the strut channel member 103 is contiguous with the step segment 112. The curved segment 113 curves, at one end, inward from the terminal end of the step portion 112. The curved segment 113 is contiguous, at the other end, with an inverted L-shaped inwardly-angled segment 114.

Figure 3A:
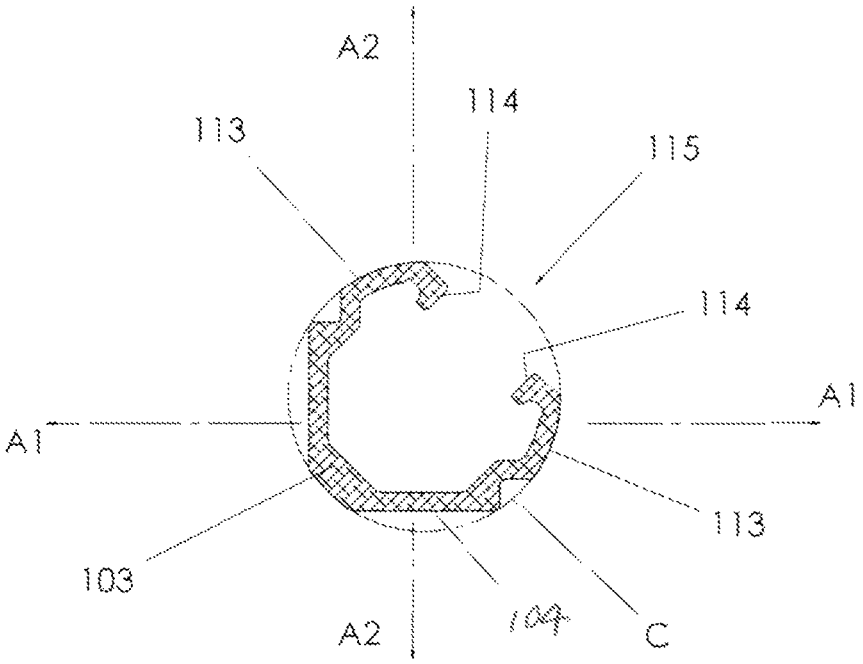
FIG. 3A is cross-section view of a strut channel member of the present system, apart from other elements of the present system.

In an alternative embodiment, and as shown in FIG. 3A, the curved segment 113 is contiguous with the side segment 104. As stated above, the side segment 104 may be flat or curved, but the curved segment 113 is configured to curve inward to form an essentially circular interior channel region 116.

In a preferred embodiment, the inwardly-angled segment 114 extends from the terminal end of the curved segment, and is oriented about 45 degrees inward from the corresponding curved segment 113. As illustrated, the two opposing inwardly-angled segments 114 extend toward each other, and are spaced apart from each other to form a gap region 115 therebetween. The gap region 115 is preferably slightly greater than ½ inch wide to accommodate a ½ inch bolt therewithin. The function of the gap region 115 is to fasten equipment to the strut channel member 103, as described further below. The interior channel region 116 of the strut channel member 103, as defined by the corner segment 110, and the opposing side segments 104, curved segments 113, and inwardly-angled segments 114 is hollow, forming the channel 116 therethrough. In a preferred embodiment, the wall thickness of the strut channel member 103 is approximately ⅛ inch.

Figure 3B:
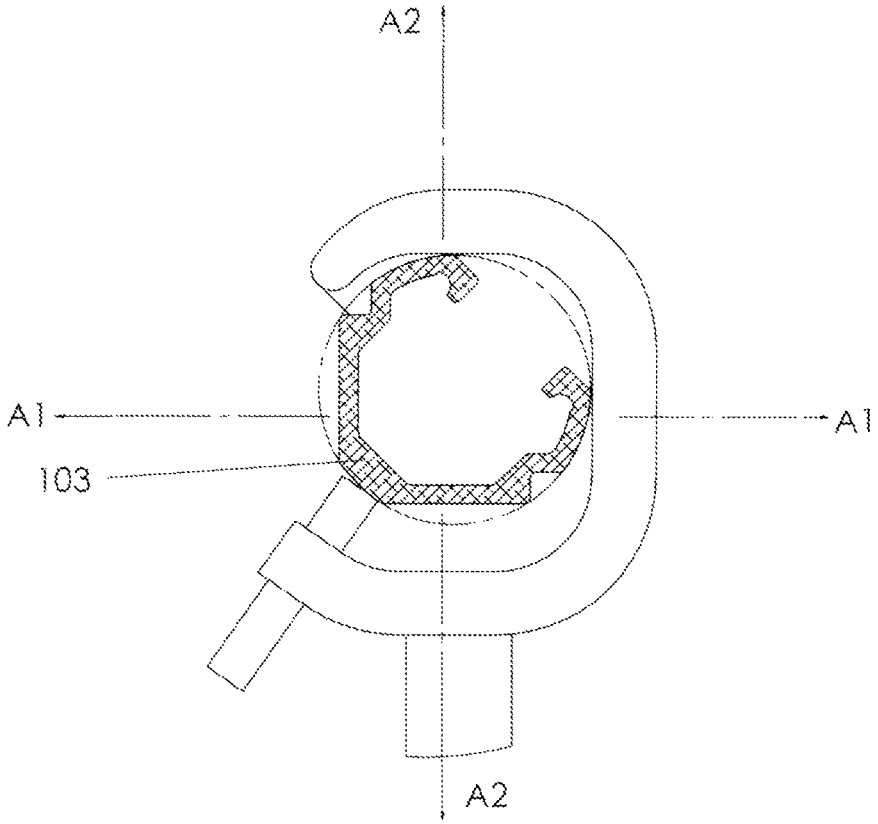
FIG. 3B is a cross-section view of the strut channel member of FIG. 3A, showing a clamp system in position around the exterior of the strut channel member.

As illustrated in FIG. 3A, the specific configuration of the strut channel member, follows an essentially concentric configuration, regardless of whether or not the side segments 104 are flat/straight or curved. This allows industry standard C-clamps to be clamped to the surface of the strut channel member 103, as illustrated in FIG. 3B. Typically, C-clamps are designed for a 2-inch diameter pipe or tube. The present specific configuration of the strut channel member 103 facilitates the fastening of the industry standard C-clamps.

In addition, by including an inwardly-angled segment 114, the specific configuration of the strut channel member 103 provides a secure structure to which a light fixture or other unit may securely be attached using standard attachment devices, such as a nut/bolt device or a spring nut device, that fit within the interior channel member 116. By providing this unique strut channel configuration, the truss system 100 has superior flexibility, with respect to the range of elements that can be attached to the system, while providing an overall structural integrity to the system.

Figure 4:
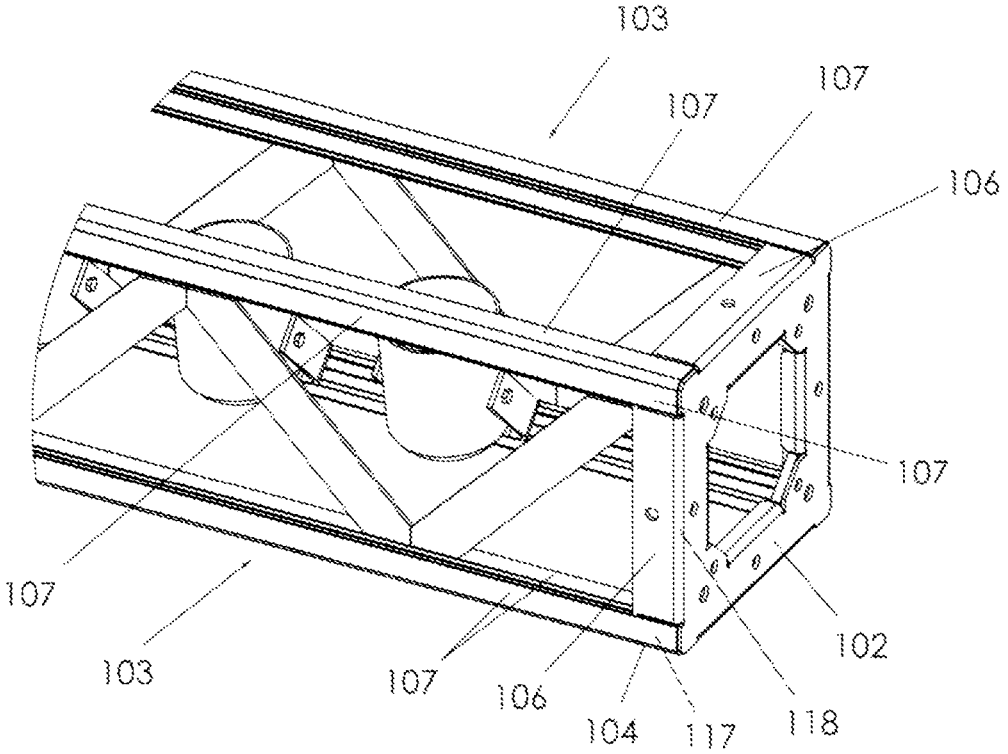
FIG. 4 is an isometric close-up view of one end of the present truss system.

In a preferred embodiment, and as shown in FIG. 4, each strut channel member 103 includes two adjacent channel member sides 107 positioned at 90 degrees from each other, and corresponding to the side segments 104. Each structural flange 106 includes opposing fastening end portions 117, located at each end of the flange 106.

In a preferred embodiment, the structural flange 106 is integral with the end plate 102, formed by bending the end plate 102 at an angle of 90 degrees along the flange seam 118. The short ends of the structural flange 106 then is welded to the side channel member 107, and ground for a flush fit along the top edge of the side channel member 107.

In another embodiment, construction of the strut channel member 103 includes securing the fastening end portion 117 of each structural flange 106 to the interior wall of a corresponding channel member side 107 at the side segment 104. In that embodiment the fastening end portion 117 of each structural flange extends at least a portion of the width of the corresponding channel member side 107. The extra area at each end of each structural flange 106 that defines the fastening ends 117, increases the strength of the union of the strut channel members 103 to the end plate 102. All structural flanges 106 of the system are similarly fastened to the corresponding strut channel members 103, as illustrated. In a preferred embodiment, the fastening end portion 117 is welded to the interior surface of the corresponding structural flange 106 and ground for a flush fit.

Figure 5:
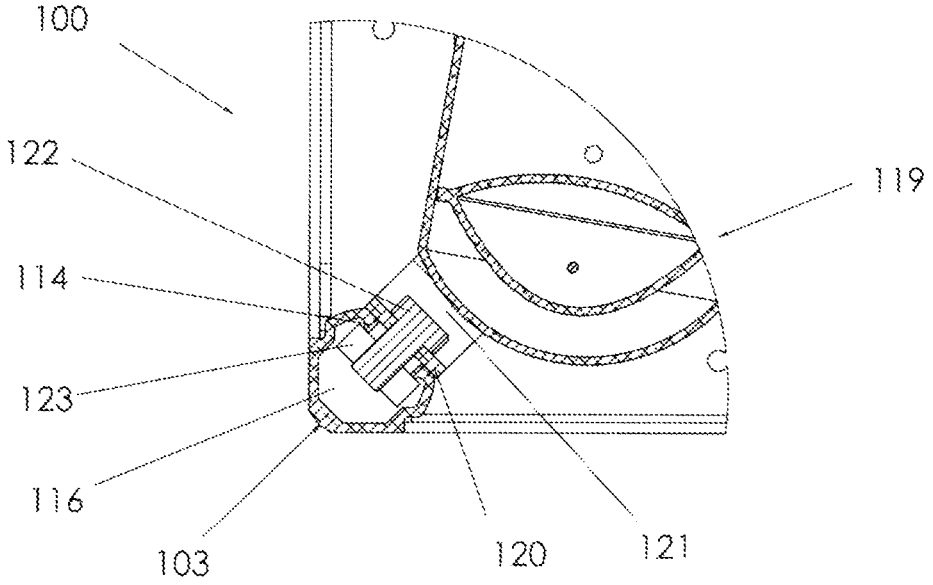
FIG. 5 is a cross-section view of a corner of the truss system of FIG. 1, showing a lighting fixture mounted to the truss section.

Referring to FIG. 5, a cross-section of the truss system 100 is shown, including a lighting fixture 119. The yoke base 120 is shown fastened to the inwardly-angled segments 114 with a bolt 122. In a preferred embodiment, and depending on the specific dimensions of the subject system 100, the bolt 122 is a ½ inch bolt. The bolt 122 is fastened with a nut plate 123. In the embodiment having a ½ inch bolt, the nut plate also will be a corresponding ½ inch. The nut plate 123 is situated in the interior channel region 116 of the strut channel member 103. The yoke base 120 is connected to the lighting fixture 119 by yoke arm side members 121.

In a preferred embodiment, the yoke base 120 includes a yoke arm side member 121 at both ends of the yoke base 120. The lighting fixture is typical of the type used in stage lighting. Most lighting fixtures are configured with a 9/16" hole or a 14 mm hole to facilitate mounting to either unistrut or to an industry standard C-clamp of the type discussed above. This hole typically is located in the center of the yoke base 120.

Other equipment and devices can be mounted to the strut channel members 103. Examples, but not limited to, include sound equipment and rigging devices or equipment.

Figure 6:
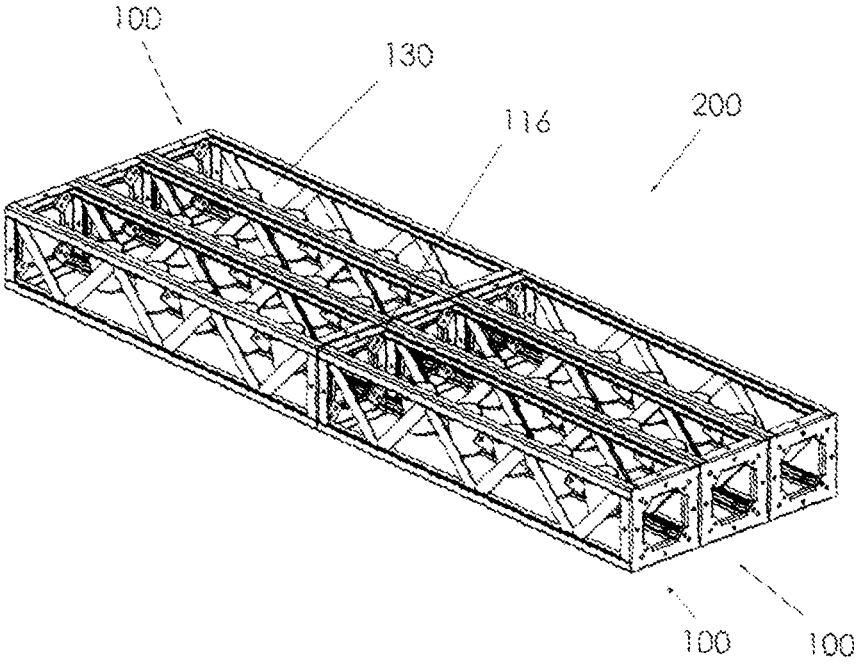
FIG. 6 is an isometric view of an assembly of truss systems, configured for use as a stage riser.

Referring to FIG. 6, a number of truss systems 100 can be connected to form a truss assembly 200. In the illustrated embodiment of FIG. 6, the assembly 200 is a stage riser. In that illustrated embodiment, a transparent plastic panel 130 is installed between two or more strut channel members 103 to allow light to exit and to provide a place for users to step while installing the assembly. The mounting holes 111 located on the reinforcement plates 109 (not shown in this figure) and on the end plates 102 can be used to secure multiple truss systems 100 together to form various assemblies 200.

Figure 7:
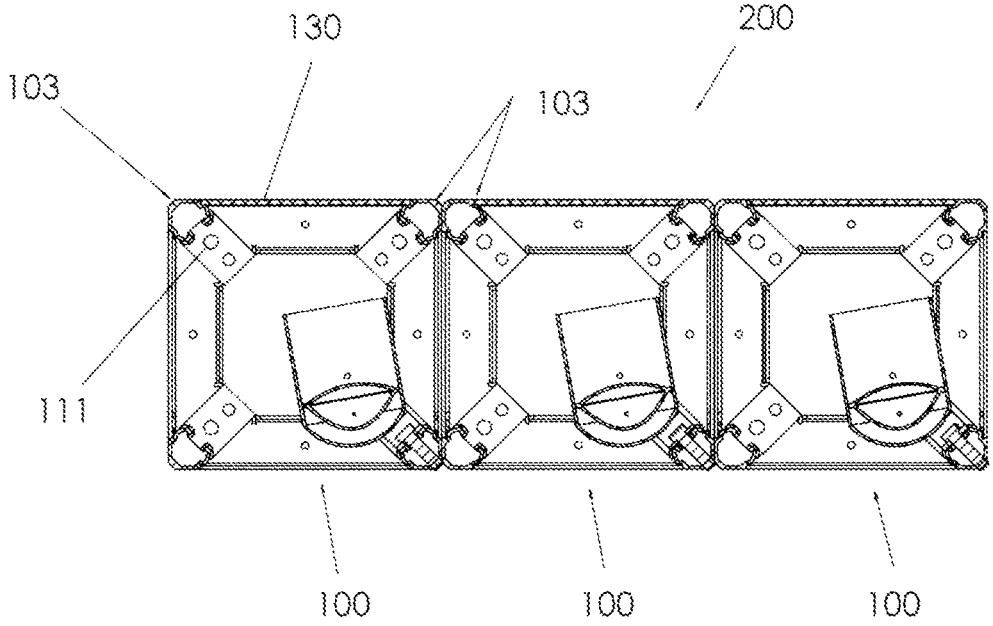
FIG. 7 is a cross-section view of the truss assembly of FIG. 6.

FIG. 7 shows a cross-section of the stage riser assembly 200 shown in FIG. 6. The transparent plastic panel 130 is shown extending across the strut channel members 103. In a preferred embodiment, the thickness of the opaque plastic panel 130 is approximately ¼ inch. In a preferred embodiment, the plastic panel is made from a polycarbonate sheet. Alternatively, the panel may be made from PVC and acrylic sheets, and any other similar transparent, flexible, semi-rigid materials known and used by those in the field.

Figure 8:
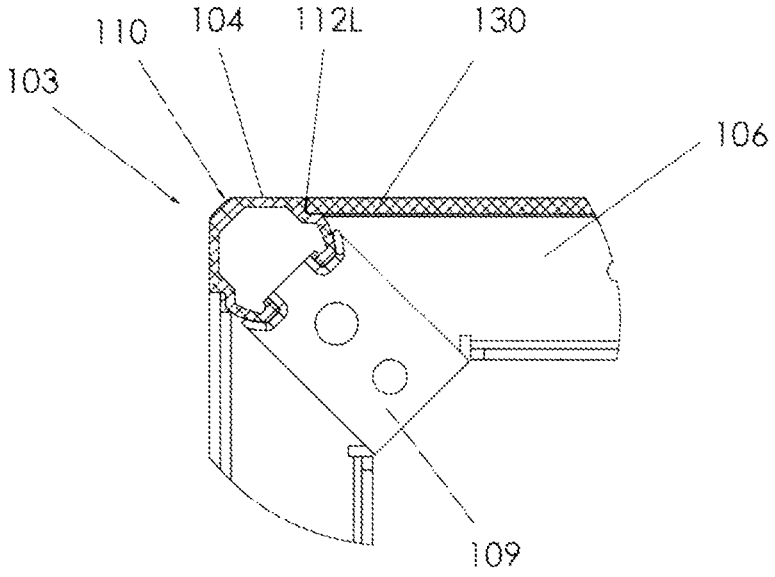
FIG. 8 is a close-up view of one corner of FIG. 7.

FIG. 8 shows the corner detail of the strut channel members 103 in the assembly of FIG. 6. In the illustrated embodiment, the transparent plastic panel 130 is recessed in the step segment length portion 112L of the strut channel member 103. The top surface of the transparent plastic panel 130 is flush and generally planer with the side segment 104 of the truss member 103. Thus, the inclusion of the step segment 112 provides a more precise fit between the strut channel member 103 and the transparent panel 130, which allows for a more secure connection. The step segment 112, particularly when used in combination with the transparent panel 130, allows for a more secure connection between the strut channel member 103 and the structural flanges 106.

Figure 9:
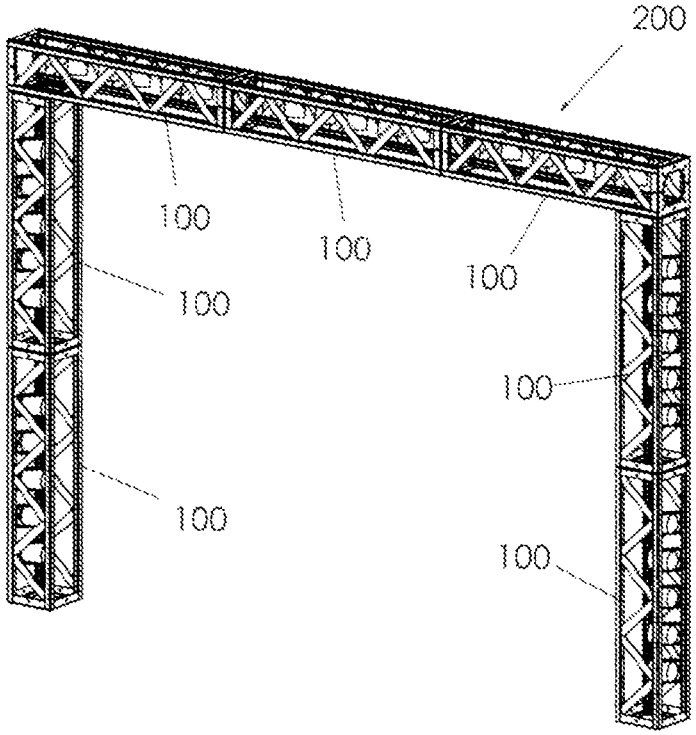
FIG. 9 is a view of an assembly of truss systems fastened together forming an overhead truss.

Referring to FIG. 9, this is a view of an alternative embodiment of an assembly 200 of the present truss systems 100 fastened together to form an overhead truss. Seven of the truss systems 100 are utilized to build the illustrated overhead truss assembly 200. Three of the seven systems 100 are configured horizontally. Two of the systems 100 are configured as vertical towers to elevate the horizontal sections on the left side. The other two systems 100 are used to elevate the horizontal systems on the right side. It should be noted that an unlimited number of assemblies 200 can be imagined and deployed using the present truss system 100. The specific configuration of each assembly is dependent on the space available and the available number of truss systems 100. In a preferred embodiment, the truss systems 100 are fastened together to form the assemblies using bolts, or other connectors standard in the relevant industry, connected through mounting holes 111 (not shown in this FIG. 9) that are aligned between the truss systems 100.

Figure 10:
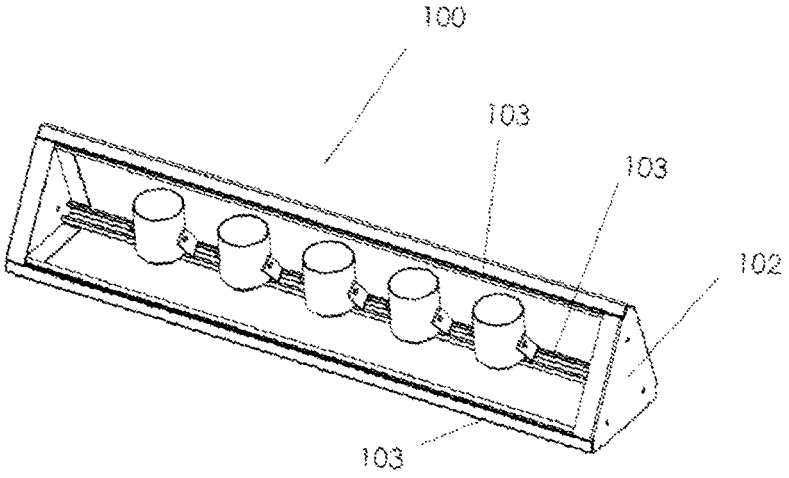
FIG. 10 is an alternate triangular configuration of the present truss system.

FIG. 10 shows an alternate embodiment of the present truss system 100. In this embodiment, the end plates 102 are a triangular shape. For this embodiment, only three strut channel members 103 are required. As with the square embodiment previously described, the interior channel region 116 (not shown in this FIG. 10) of the strut channel members 103 are oriented inward, toward the center of the truss system, facing the lighting fixture 119 or other installed component.

The truss system 100 preferably is manufactured of extruded aluminum main truss chords/members. The integrated strut channel member 103 are specifically configured in a circular shape to allow the mounting of lights, speakers, and other equipment, which reduces the cost of constructing systems 100 as well as assemblies 200. In addition, by having the mounting elements of the attached equipment contained within the interior channel 116 of the strut channel members, it limits accidental damage to the mounting elements and the attached equipment.

In addition, because the present truss system 100 is configured to allow lights and other mounted equipment to be enclosed within the interior of the truss system 100, it not only protects the equipment from damage, but it also facilitates fast setup and strike down of assemblies for users of the system. The entire system 100 can be left fully assembled with all attached equipment, transported from one location to the next, and then assembled into the desired assembly 200 configuration on location.

The structural integrity of each system 100, by inclusion of the cross brace members 108, together with the entire construction of each system 100, permits the system to be weight-bearing, i.e., a user may step on the system, if necessary, for example, during assembly of a desired assembly configuration. This is particularly true when the plastic panels 130 are positioned, as described.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What I claim is:

1. A truss system, comprising:

A. first and second rigid end plates,

B. a plurality of elongate strut channel members disposed between the first and second rigid end plates, each channel member having a first channel member end and an opposing second channel member end positioned along a channel member axis, wherein each of the first channel member ends is attached to the first rigid end plate, and each of the second channel member ends is attached to the second rigid end plate, wherein the first rigid end plate, the second rigid end plate, and the plurality of elongate strut channel members define a hollow interior within the truss system;

wherein each elongate strut channel member includes:

i. two side segments extending radially along respective intersecting side segment axes, each side segment having a proximal corner end at which the two segments are attached, and a side segment distal end;

ii. a first curved segment, integral at a first curved segment proximal end with the side segment distal end of one of the side segments, and which first curved segment curves inward at a first curved segment distal end; and iii. a second curved segment, integral at a second curved segment proximal end with the side segment distal end of the other of the side segment, and which second curved segment curves inward at a second curved segment distal end;

wherein the side segments and the curved segments are circularly configured about a hollow interior channel, which channel extends along the channel member axis, and the first curved segment distal end is spaced apart from the second curved segment distal end to form a gap region that is continuous with the hollow interior channel and is directed toward the hollow interior of the truss system.

2. The truss system of claim 1, wherein at least one curved segment distal end includes a terminal inwardly-angled segment.

3. The truss system of claim 1, further comprising a plurality of rigid structural flanges extending inward along the channel member axis at about a 90 degree angle from each rigid end plate and including opposed flange terminal ends, wherein each flange terminal end is attached to one side segment of two strut channel members.

4. The truss system of claim 1, further comprising a plurality of rigid cross brace members having opposing ends, each cross brace member attached at each end to at least one side segment of two strut channel members, wherein each cross brace member is positioned between the two strut channel members at an acute angle thereto.

5. The truss system of claim 1, wherein the side plates include a plurality of reinforcement plates attached thereto, and positioned adjacent each strut channel member extending from the rigid end plate.

6. A truss system, comprising:

A. two rigid end plates,

B. a plurality of elongate strut channel members, each channel member having a first channel member end and an opposing second channel member end positioned along a channel member axis, wherein each strut channel member is disposed between the two end plates, and wherein the first channel member end is attached to a first rigid end plate, and the second channel member end is attached to a second rigid end plate, wherein each elongate strut channel member includes:

i. two side segments extending radially along respective intersecting side segment axes, each side segment having a proximal corner end at which the two segments are attached, and a side segment distal end;

ii. a first curved segment, integral at a first curved segment proximal end with the side segment distal end of one of the side segments, and which first curved segment curves inward at a first curved segment distal end; and iii. a second curved segment, integral at a second curved segment proximal end with the side segment distal end of the other of the side segment, and which second curved segment curves inward at a second curved segment distal end;

wherein the first curved segment distal end is spaced apart from the second curved segment distal end to form a gap region therebetween;

wherein the side segments and the curved segments are circularly configured about an interior channel, which channel extends along the channel member axis; and wherein at least one curved segment further comprises a step segment, wherein the step segment comprises:

A. a length portion extending inward along a short axis, which axis transects the side segment axis at about a 90 degree angle, and B. a width portion, integral with the length portion, extending along the side segment axis, and transecting the short axis at about a 90 degree angle, and the width portion having a length terminal end and a distal curved segment terminal end.

7. A truss assembly, comprising a plurality of truss systems, wherein each truss system comprises:

A. first and second rigid end plates;

B. a plurality of elongate strut channel members, each channel member having a first channel member end and an opposing second channel member end positioned along a channel member axis, wherein each strut channel member is disposed between the first and second rigid end plates, and wherein the first channel member end is attached to the first rigid end plate, and the second channel member end is attached to the second rigid end plate, wherein the first rigid end plate, the second rigid end plate, and the plurality of elongate strut channel members define a hollow interior within the truss system; wherein each elongate strut channel member includes:

i. two side segments extending radially along respective intersecting side segment axes, each side segment having a proximal corner end at which the two segments are attached, and a side segment distal end;

ii. a first curved segment, integral at a first curved segment proximal end with the side segment distal end of one of the side segments, and which first curved segment curves inward at a first curved segment distal end; and iii. a second curved segment, integral at a second curved segment proximal end with the side segment distal end of the other of the side segment, and which second curved segment curves inward at a second curved segment distal end;

wherein the side segments and the curved segments are circularly configured about a hollow interior channel, which channel extends along the channel member axis, and the first curved segment distal end is spaced apart from the second curved segment distal end to form a gap region that is continuous with the hollow interior channel and is directed toward the hollow interior of the truss system.

8. The truss system of claim 7, wherein at least one curved segment distal end includes a terminal inwardly-angled segment.

9. The truss assembly of claim 7, wherein the truss system further comprises a plurality of rigid structural flanges extending inward along the channel member axis at about a 90 degree angle from each rigid end plate and including opposed flange terminal ends, wherein each flange terminal end is attached to one side segment of two strut channel members.

10. The truss assembly of claim 7, wherein the truss system further comprises a plurality of rigid cross brace members having opposing ends, each cross brace member attached at each end to at least one side segment of two strut channel members, wherein each cross brace member is positioned between the two strut channel members at an acute angle thereto.

11. The truss assembly of claim 7, wherein the truss system side plates include a plurality of reinforcement plates attached thereto, and positioned adjacent each strut channel member extending from the rigid end plate.

12. A truss assembly, comprising a plurality of truss systems, wherein each truss system comprises:

A. two rigid end plates;

B. a plurality of elongate strut channel members, each channel member having a first channel member end and an opposing second channel member end positioned along a channel member axis, wherein each strut channel member is disposed between the two end plates, and wherein the first channel member end is attached to a first rigid end plate, and the second channel member end is attached to a second rigid end plate, wherein each elongate strut channel member includes:

i. two side segments extending radially along respective intersecting side segment axes, each side segment having a proximal corner end at which the two segments are attached, and a side segment distal end;

ii. a first curved segment, integral at a first curved segment proximal end with the side segment distal end of one of the side segments, and which first curved segment curves inward at a first curved segment distal end; and iii. a second curved segment, integral at a second curved segment proximal end with the side segment distal end of the other of the side segment, and which second curved segment curves inward at a second curved segment distal end;

wherein the first curved segment distal end is spaced apart from the second curved segment distal end to form a gap region therebetween;

wherein the side segments and the curved segments are circularly configured about an interior channel, which channel extends along the channel member axis; and wherein at least one curved segment further comprises a step segment, wherein the step segment comprises:

A. a length portion extending inward along a short axis, which axis transects the side segment axis at about a 90 degree angle, and B. a width portion, integral with the length portion, extending along the side segment axis, and transecting the short axis at about a 90 degree angle, and the width portion having a length terminal end and a distal curved segment terminal end.

* * * * *